United States Patent [19]

Kratz et al.

[11] Patent Number: 4,750,426

[45] Date of Patent: Jun. 14, 1988

[54] SUBMUNITION

[75] Inventors: Bernhard Kratz, Wendelstein; Fritz Muller, Nurnberg, both of Fed. Rep. of Germany

[73] Assignee: Diehl GmbH & Co., Nurnberg, Fed. Rep. of Germany

[21] Appl. No.: 61,097

[22] Filed: Jun. 10, 1987

[30] Foreign Application Priority Data

Jul. 9, 1986 [DE] Fed. Rep. of Germany ..... 3623128

[51] Int. Cl.[4] ..... F42C 19/06

[52] U.S. Cl. ..... 102/397; 102/216

[58] Field of Search ..... 102/204, 216, 393, 397

[56] References Cited

U.S. PATENT DOCUMENTS

| | | | |
|---|---|---|---|
| 1,340,546 | 5/1920 | Keeran | 102/397 |
| 3,173,365 | 3/1965 | Battaglini | 102/397 |
| 3,306,199 | 2/1967 | Karin et al. | 102/397 |
| 3,515,067 | 6/1970 | Min | 102/397 |
| 4,567,829 | 2/1986 | Ziemba et al. | 102/397 |
| 4,620,483 | 11/1986 | Simpson | 102/216 |

FOREIGN PATENT DOCUMENTS

| | | | |
|---|---|---|---|
| 3137198 | 4/1983 | Fed. Rep. of Germany | 102/397 |

*Primary Examiner*—Charles T. Jordan

*Attorney, Agent, or Firm*—Scully, Scott, Murphy & Presser

[57] ABSTRACT

An article of submunition, having a housing on which there is arranged an outwardly extendable distance feeler or spacer support. A head on the support carries a sensor which is connected through the intermediary of a connector cable to an evaluating circuit which is arranged within the housing. The connector cable is formed as a ribbon-shaped or flat cable which is constituted of plastic material, in which the flat cable is bifilarly or double wound into a spiral, wherein the winding axis lies transversely of the longitudinal direction of the flat cable, in which the spiral of the flat cable has its shape stabilized through a thermal treatment, and in which the spiral is located adjacent the distance feeler support.

5 Claims, 1 Drawing Sheet

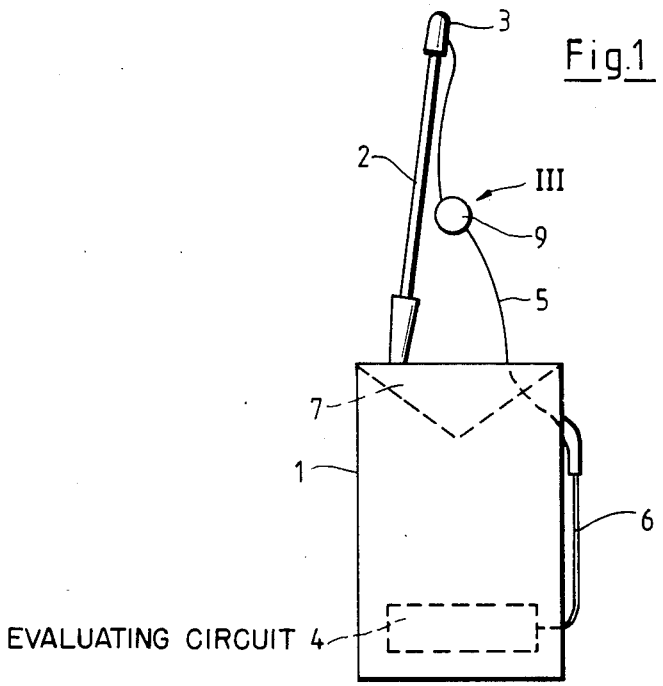
Fig.1
Fig.2
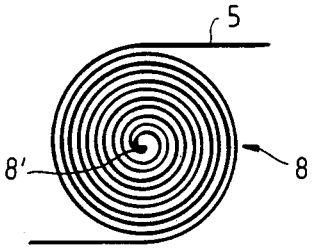
Fig.3
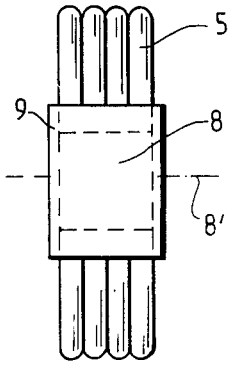

SUBMUNITION

BACKGROUND OF THE INVENTION

1. Field of the Invention

The present invention relates to an article of submunition, having a housing or casing on which there is arranged an outwardly extendable distance feeler or spacer support. A head on the support carries a sensor which is connected through the intermediary of a connector cable to an evaluating circuit which is arranged within the casing.

2. Discussion of the Prior Art

An arrangement of that type is described in the disclosure of German patent No. 31 37 198. Prior to the striking of the submunition against a target, the support for the distance feeler is extended outwardly. Upon striking against the target, an impact or percussion sensor will respond, which sensor is arranged on the head of the support for the distance feeler. As a consequence thereof, there is afforded the obtention of an adequate detonating distance between the target and the submunition.

The sensor is connected with the evaluating circuit through a connector cable, whereby the evaluating circuit is arranged in the housing at a side facing away or distant from the carrier for the submunition. The displacement of this connector cable is the source of most of the encountered difficulties. The connector cable should be secured within the housing when the distance feeler is not extended, and during the outward displacement of the distance feeler, should be able to be drawn out of the housing without to any appreciable extent obstructing the outward displacement of the distance feeler. In addition thereto, the connector cable should be so offset or displaced with regard to the evaluating circuit, that it will practically not adversely influence to any degree the functioning of the active charge which is located within the housing.

SUMMARY OF THE INVENTION

Accordingly, it is an object of the invention to provide a submunition of the above-mentioned type in which the connector cable is displaced in such a manner as not to adversely influence the functioning of the submunition.

Inventively, the foregoing object is attained in a submunition of the above-mentioned type, in that the connector cable is formed as a ribbon-shaped or flat cable which is constituted of plastic material, in which the flat cable is bifilarly or double wound into a spiral, wherein the winding axis lies transversely of the longitudinal direction of the flat cable, in which the spiral of the flat cable has its shape stabilized through a thermal treatment, and in which the spiral is located adjacent the distance feeler support.

Through the utilization of a ribbon-shaped or flat cable which is constituted of a plastic material, wherein the individual conductors are located adjacent each other, there is afforded a flexible displaceability in comparison with another cable. In contrast with the displacement of individual wire strands, there is avoided the danger that the individual wire strands will wind together or entangle with each other during the outward displacement of the distance feeler. Through the bifilar winding of the flat cable, that portion of the flat cable is stored in a space-saving or compact manner, as is necessary so as not to obstruct the outward displacement of the distance feeler. Through the thermal treatment of the spiral of flat cable, there is achieved an elimination of the inherent tendency of the plastic flat cable to unroll itself into a flat or extended state. During the outward extension of the distance feeler, the bifilar spiral can be easily drawn open. Through the arrangement of the spiral adjacent the distance feeler, the cables need not be positioned in the primarily telescopably extendable distance feeler.

In order to avoid the presence of additional connecting locations between the sensor and the evaluating circuit, in a preferred embodiment of the invention, the ribbon-shaped or flat cable is directly connected with the sensor and the evaluating circuit. As a result, there is obviated the need for socket plug or soldered connections during the course of forming the electrical connection between the sensor and the evaluating circuit. Such additional connecting locations would normally be necessary when a comparatively rigid cable would have to be arranged between the evaluating circuit and the base area of the distance feeler, and comparatively flexible cable strands arranged between the base area and the sensor.

BRIEF DESCRIPTION OF THE DRAWINGS

Reference may now be had to the following detailed description of an exemplary embodiment of the invention, taken in conjunction with the accompanying drawings; in which:

FIG. 1 illustrates a submunition with an outwardly extended distance feeler;

FIG. 2 illustrates a bifilarly wound spiral of ribbon-shaped or flat cable; and FIG. 3 illustrates, on an enlarged scale, a fragmentary view in the direction of arrow III in FIG. 1.

DETAILED DESCRIPTION

An article of submunition possesses a casing or housing 1. Supported at the forward end thereon is a distance feeler 2 in a pivotable and telescopably extendable manner. A sensor 3 is fastened to the head end of the distance feeler 2. An electronic evaluating circuit 4 is arranged in the rearward end of the housing 1.

For effecting the connection between the sensor and the evaluating circuit 4 there is provided a ribbon-shaped or flat cable 5 which is constituted of a plastic material. This cable is conducted in a region 6 from the evaluating circuit 4 outwardly along the housing 1 into an open space which is provided in the front of the housing 1. In the space 7, the flat cable 5 is wound bifilarly into a spiral 8. The bifilar winding of the spiral 8 is illustrated in FIG. 2 of the drawings. The winding axis 8' extends perpendicular to the longitudinal direction of the flat cable 5, as is shown in FIG. 3.

In order to avoid the spiral 8 from inherently or spontaneously unrolling because of the restoring force or action of the flat cable 5, the flat cable 5 is thermally treated in a manner in the region of the spiral subsequent to being wound, such that the restoring force of the flat cable 5 will dissipate.

The spiral 8 is inserted into a spool 9, as illustrated in FIGS. 1 and 3.

As long as the distance feeler 2 has not been outwardly extended and remains retracted against the housing 1, the spool 9 is located within the open space 7 adjacent the distance feeler 2 in the housing 1.

When the distance feeler 2 is released, then it swings out and is extended outwardly. As a result thereof, the spiral 8 is correspondingly unrolled, as is illustrated in FIG. 1.

What is claimed is:

1. In a submunition having a housing; an outwardly extendable distance feeler fastened to said housing; a sensor being supported on the head end of said distance feeler; an evaluating circuit in said housing; and a connector cable connecting said sensor with said evaluating circuit; the improvement comprising in that said connector cable is a ribbon-shaped flat cable constituted of a plastic material which is bifilarly wound into a spiral in the retracted position of said distance feeler, said spiral having a winding axis extending transversely of the longitudinal axis of the flat cable, said flat cable spiral being stabilized in shape by a thermal treatment, and said spiral being located adjacent the retracted distance feeler.

2. Submunition as claimed in claim 1, wherein the flat cable spiral is thermally stabilized so as to eliminate the inherent tendency of unrolling of the plastic flat cable.

3. Submunition as claimed in claim 1, wherein the flat cable in an extension of said spiral is conducted outwardly along the housing to said evaluating circuit.

4. Submunition as claimed in claim 1, in which the flat cable is directly connected with the sensor and the evaluating circuit.

5. Submunition as claimed in claim 1, wherein the flat cable spiral is arranged in a coiling spool.

* * * * *